US009653811B2

(12) United States Patent
Khalil et al.

(10) Patent No.: US 9,653,811 B2
(45) Date of Patent: May 16, 2017

(54) DIPOLE ANTENNA WITH MICRO STRIP LINE STUB FEED

(71) Applicant: The Government of the United States, as represented by the Secretary of the Army, Washington, DC (US)

(72) Inventors: Mahmoud Khalil, Lincroft, NJ (US); Shuguang Chen, Ellicott City, MD (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 68 days.

(21) Appl. No.: 14/719,846

(22) Filed: May 22, 2015

(65) Prior Publication Data

US 2016/0344103 A1 Nov. 24, 2016

(51) Int. Cl.

| | |
|---|---|
| ***H01Q 1/38*** | (2006.01) |
| ***H01Q 9/16*** | (2006.01) |
| ***H01Q 1/50*** | (2006.01) |
| ***H01Q 9/06*** | (2006.01) |

(52) U.S. Cl.

CPC ..... *H01Q 9/16* (2013.01); *H01Q 1/38* (2013.01); *H01Q 1/50* (2013.01); *H01Q 9/065* (2013.01)

(58) Field of Classification Search

CPC H01Q 9/16; H01Q 9/065; H01Q 1/50; H01Q 1/38

USPC ..... 343/700 MS, 821

See application file for complete search history.

(56) References Cited

U.S. PATENT DOCUMENTS

| | | | | |
|---|---|---|---|---|
| 5,376,943 | A * | 12/1994 | Blunden | G08G 1/017 343/702 |
| 6,147,653 | A | 11/2000 | Wallace et al. | |
| 6,987,483 | B2 * | 1/2006 | Tran | H01Q 9/285 343/700 MS |
| 8,184,063 | B2 * | 5/2012 | Qi | H01Q 9/20 343/793 |
| 8,446,331 | B2 * | 5/2013 | Johnson | H01Q 1/38 343/803 |
| 8,463,179 | B2 | 6/2013 | Mohammadian | |
| 8,648,756 | B1 | 2/2014 | Desclos et al. | |
| 8,780,001 | B2 | 7/2014 | Lee | |
| 8,810,467 | B2 | 8/2014 | Lee et al. | |
| 8,830,135 | B2 | 9/2014 | Dean et al. | |
| 8,860,621 | B2 | 10/2014 | Zhang | |
| 8,878,742 | B1 | 11/2014 | Jenn | |
| 8,890,760 | B2 | 11/2014 | Chen et al. | |
| 8,902,117 | B2 | 12/2014 | Ohno et al. | |
| 2007/0182656 | A1 | 8/2007 | Qi et al. | |
| 2009/0079653 | A1 | 3/2009 | Semonov et al. | |
| 2009/0315800 | A1 | 12/2009 | Qi et al. | |
| 2014/0132469 | A1 | 5/2014 | Wang et al. | |
| 2015/0133908 | A1 | 5/2015 | Brannan et al. | |

* cited by examiner

*Primary Examiner* — Brian Young

(74) *Attorney, Agent, or Firm* — Ronald Krosky; Azza Jayaprakash

(57) ABSTRACT

Various embodiments are described that relate to a line feed and a dipole element. The line feed can be supplied directly with a current without a balun. Being supplied with this current can cause the line feed to emit an electromagnetic field. This electromagnetic field can excite a dipole element with two sides. Through this excitement, the dipole element can have current flowing in a uniform direction on both sides.

20 Claims, 9 Drawing Sheets

DIPOLE ANTENNA WITH MICRO STRIP LINE STUB FEED

GOVERNMENT INTEREST

The innovation described herein may be manufactured, used, imported, sold, and licensed by or for the Government of the United States of America without the payment of any royalty thereon or therefor.

BACKGROUND

Communication can occur between two devices. These devices can each employ an antenna to facilitate such communication. The better performing the antenna, the better the communication that can occur between the two devices. In view of this, it may be beneficial to have a better performing antenna.

In actual usage, antennas can be attached to vehicles, equipment, and the like. As time goes on, these antennas can break. A low cost replacement antenna can be a valuable tool. In view of this, it may be beneficial for these antenna to be of a relatively low cost.

SUMMARY

In one embodiment, a system can comprise a dipole element and a line feed. The line feed can be configured to be supplied with a current such that the line feed emits an electromagnetic field when supplied with the current. The electromagnetic field can excite the dipole element such that the dipole element is balanced.

In one embodiment, a system can comprise an antenna and a connector. The antenna can comprise a dipole element, a line feed, and a separator that separates the dipole element from the line feed such that the dipole element and the line feed do not touch. The connector can be configured to connect to a current supply to the antenna such that the line feed is provided the current. The line feed can be provided the current and when this occurs the line feed can emit an electromagnetic field that interacts with the dipole element. The dipole element can be excited by the electromagnetic field such that current flows through the dipole element.

In one embodiment, a system comprises a dipole element and a line feed. The dipole element can comprise a first radiating element and a second radiating element. The line feed can be substantially parallel to the dipole element and does not touch the dipole element. The line feed can emit an electromagnetic field that excites the dipole element such that the first radiating element and the second radiating element have current travelling in a uniform direction.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1:
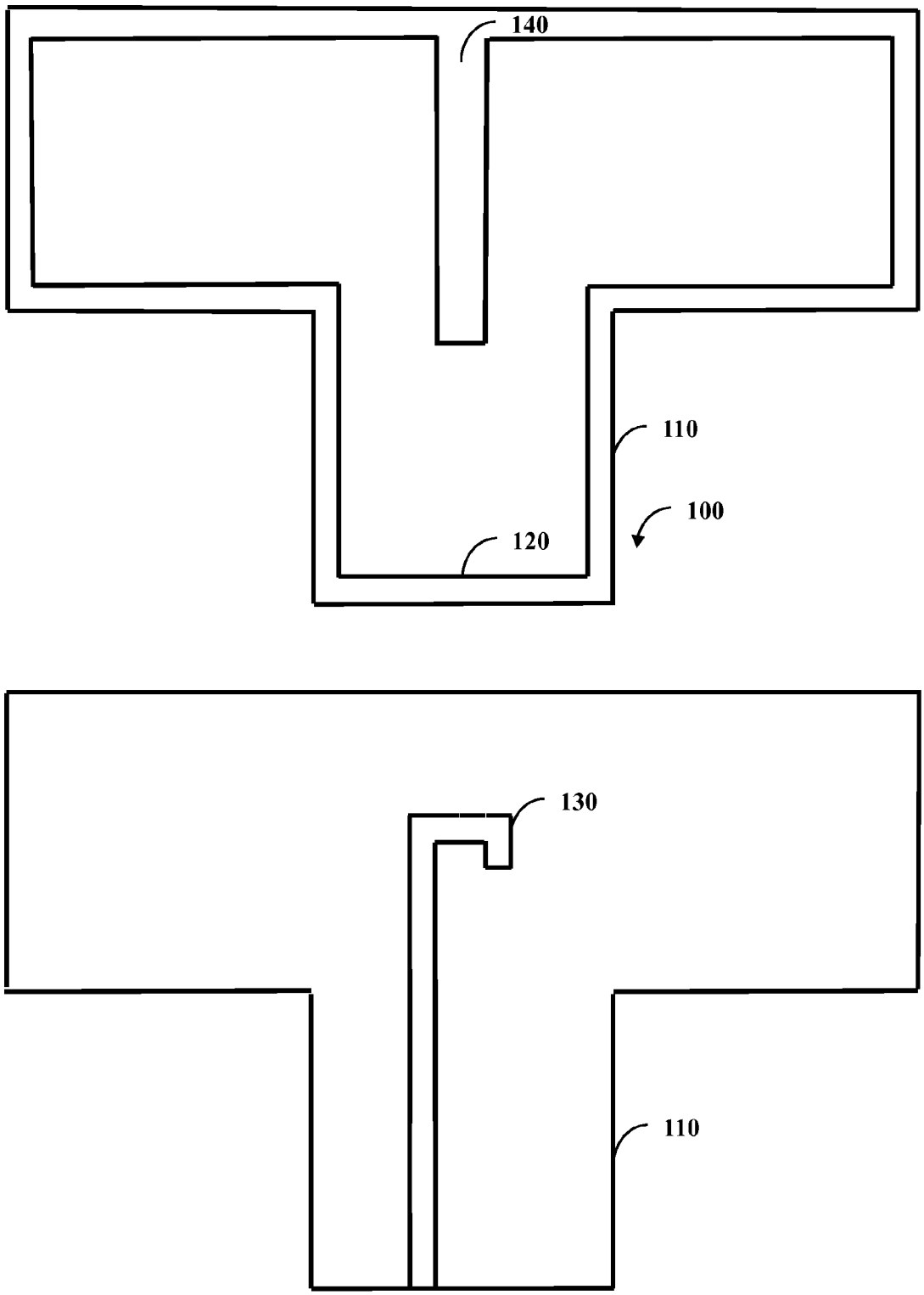
FIG. 1 illustrates one embodiment of different sides of a system.

In one embodiment, an antenna can be supplied with an unbalanced current, but the antenna can function in a balanced manner. One way to have the antenna function in a balanced manner while being supplied with an unbalanced current is employment of a balun. Example baluns that can be used are a current balun, a folded dipole-to-coax balun (e.g., 300 Ohms to 75 Ohms), or a sleeve balun.

Adding the balun, however, adds another part to the antenna. This added part not only is likely to increase manufacturing costs, but adds complexity to the antenna. The more complex the antenna, the more challenging the antenna can be to install, correct, or replace.

To alleviate these drawbacks of a balun, an antenna can be used that does not include a balun. Two parallel and separated portions can be part of the antenna—a dipole portion and a micro strip line stub feed. The micro strip line stub feed can be provided the current directly and in response to being provided this current can emit an electromagnetic field. This electromagnetic field can excite the dipole element such that current flows through the dipole element in a balanced manner.

The benefits of aspects disclosed herein to connect a dipole antenna with an unbalanced feed line are significant. Typically a balun can be used to improve, but not fully resolve, a dipole antenna radiation pattern shape that has been distorted when using unbalanced cable. The micro strip line stub feed can be able to resolve the dipole antenna radiation pattern more finely by further limiting an amount of common mode current flowing in the feed line as compared to a balun. Other improvements over using a balun can include wider impedance bandwidth allowing for more efficient performance over a larger frequency range and cheaper manufacturing costs due to the simplicity of the design. In one example, an impedance bandwidth with a balun can be about ¼ wavelength while an impedance bandwidth based on length of a dipole element can be about ½ wavelength.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action(s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs including separate applications or code from dynamically linked libraries.

FIG. 1 illustrates one embodiment of different sides of a system 100. The system 100 can comprise a separation 110. The separation 110 can be a substrate or open space and examples of the substrate can include air or a solid substrate (e.g., a set of spacers or plastic item). On one side of the separation 110 can be a dipole element 120 and on the other side of the separation 110 can be a line feed 130 (e.g., a micro strip line stub feed). The separation 110 can be an actual element, such as a formed plastic that functions as a solid substrate, or is open space. The solid substrate can physically support the dipole element 120 and/or the line feed 130. Regardless of the separation configuration, the dipole element 120 and the line feed 130 can be configured such that they do not touch. In FIG. 1, the upper portion is dedicated to the dipole element side and the lower portion is dedicated to the line feed side.

While the line feed 130 is illustrated as being in a hook shape, various other shapes can be used. The line feed 130 can be supplied with a current (e.g., supplied with an electric current or supplied with a voltage). In response to being supplied with this current, the line feed 130 can emit an electromagnetic field in multiple directions. As part of this multiple direction emission, the electromagnetic field can pass over the dipole element 120.

The dipole element 120 can be excited by the electromagnetic field. This excitement can occur through an exciting point 140 (e.g., an open space) for the dipole element 120. This excitement can cause the dipole element 120 to be balanced.

Figure 2:
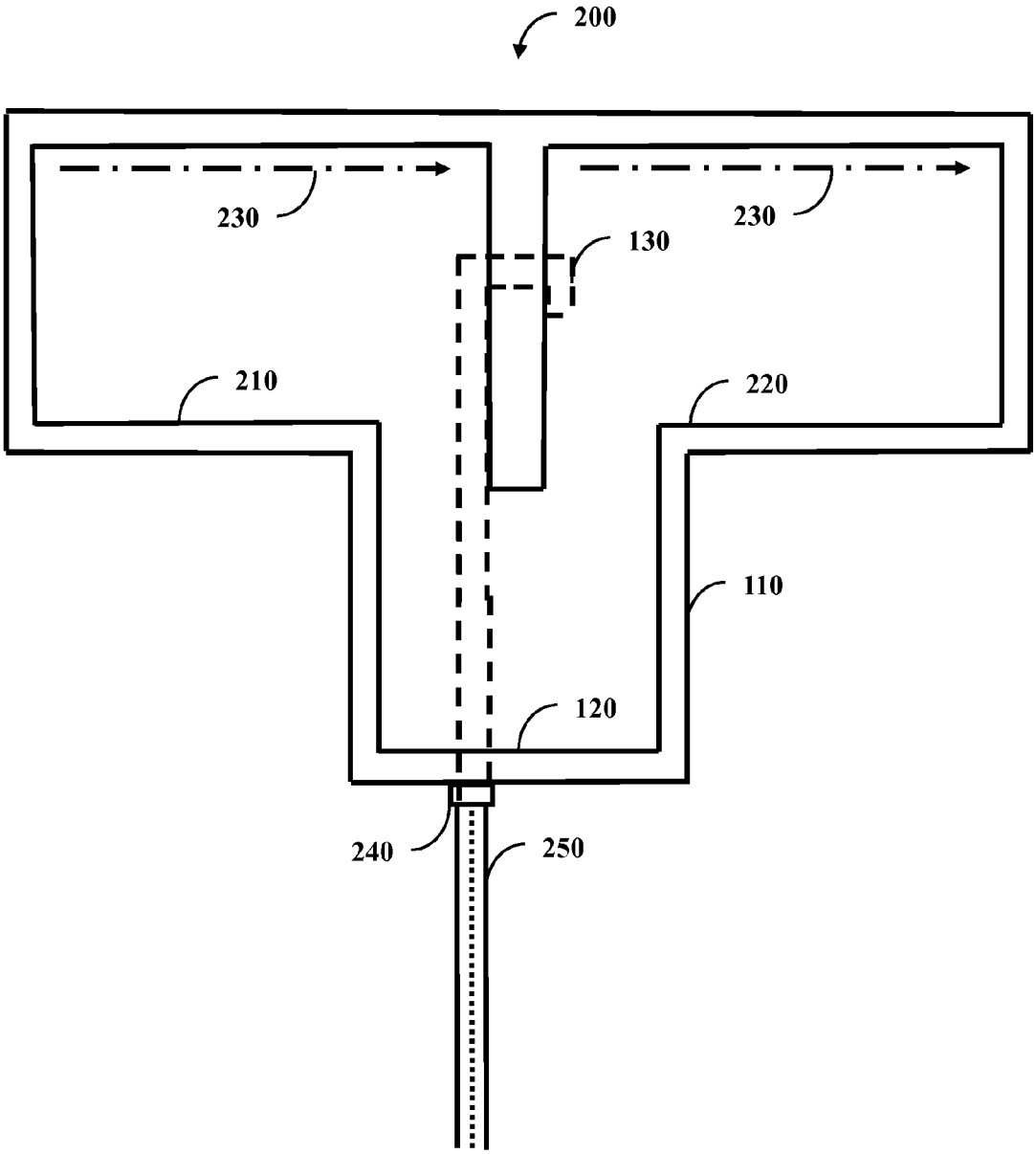
FIG. 2 illustrates one embodiment of a system from a stacked perspective.

FIG. 2 illustrates one embodiment of a system 200 from a stacked perspective. This stacked perspective illustrates how the dipole element 120, the separation 110, and the line feed 130 line up with one another. The line feed 130 is illustrated as dashed because it is behind the separation 110 and the dipole element 120.

The dipole element 120 and the line feed 130 can be on substantially parallel planes to one another that are different planes. This way, they do not touch. However, they can be close enough together so the line feed 130 excites the dipole element 120.

This excitement can cause current to flow through the dipole element 120. The dipole element 120 can have different sides—a first radiating element 210 and a second radiating element 220. These sides can be balanced and being balanced can include current 230 flowing in a uniform direction on both sides of the dipole element 120. The dipole element 120 can physically touch one side of the separation 110 when the separation 110 is a solid substrate, while the line feed 130 can physically touch the opposite side of the solid substrate without touching the dipole element 120. Depth of the solid substrate that separates the dipole element 120 from the line feed 130 can influence impedance matching of the dipole element 120.

To produce the electromagnetic field that excites the dipole element 120 to ultimately be balanced, the line feed 130 can receive the current 230. The current 230 can be received by way of a connector 240. The connector 240 can be configured to directly connect with a supplier of the current 230. In one embodiment, the supplier of the current 230 is a coaxial cable 250. The coaxial cable 250 can be unbalanced, yet the dipole element 120, when excited by the electromagnetic field, can be balanced.

In one embodiment, the dipole element 120, the line feed 130, and the separator 110 (e.g., that is, at least in part, a solid substrate) can form an antenna. The separator 110 can be, at least in part, a solid substrate and the line feed 130 and the dipole element 120 can be printed on the substrate. The separator 110 can separate the dipole element 120 from the line feed 130 such that the dipole element 120 and the line feed 130 do not touch, but are on substantially parallel planes to one another. The connector 240 can be configured to connect to a current supply (e.g., the coaxial cable 250) to the antenna such that the line feed 130 is provided the current. The coaxial cable 250 can directly connect to the connector 240 such that a balun is not used. When the line feed 130 is provided the current, the line feed 130 can emit an electromagnetic field (e.g., emit an electromagnetic field substantially over a circumference of the coaxial cable) that interacts with the dipole element 120. The dipole element 120 can excited by the electromagnetic field such that the current 230 flows through the dipole element. The current supply can be unbalanced and introduces an impedance mismatch (e.g., that is mitigated by the line feed 130) while the dipole element 120 is balanced when the current 230 flows through the dipole element 120.

In one embodiment, the system 200 can be used in implementation of a new type of dipole design and impedance matching using a micro strip line feed rather than using a balun. The line feed 130 can be implemented in parallel to the two radiating elements 210 and 220 of the dipole element 120 and can also be aligned to the center of a gap between the elements (e.g., the exciting point 140 of FIG. 1). By adding the line feed 130, the impedance mismatch that is introduced by using unbalanced cable (e.g., the coaxial cable 250) can be rectified. In addition to impedance matching, the feed line 130 of can allow for the current 230 to travel in the same (e.g., parallel) direction on the two radiating elements 210 and 220 of the dipole element 120 due to the electromagnetic field that is generated. A separation gap between the two radiating elements 210 and 220 of the dipole element 120 can be optimized for impedance matching of the dipole element 120 and for distribution of the current 230 across the elements 210 and 220. This optimization can be scalable for a dipole element based, at least in part, on a frequency desired. The dipole element 120 and/or the system 200 can be unrestricted by size, shape, layering, and/or by dielectric/conductor material combination.

Figure 3:
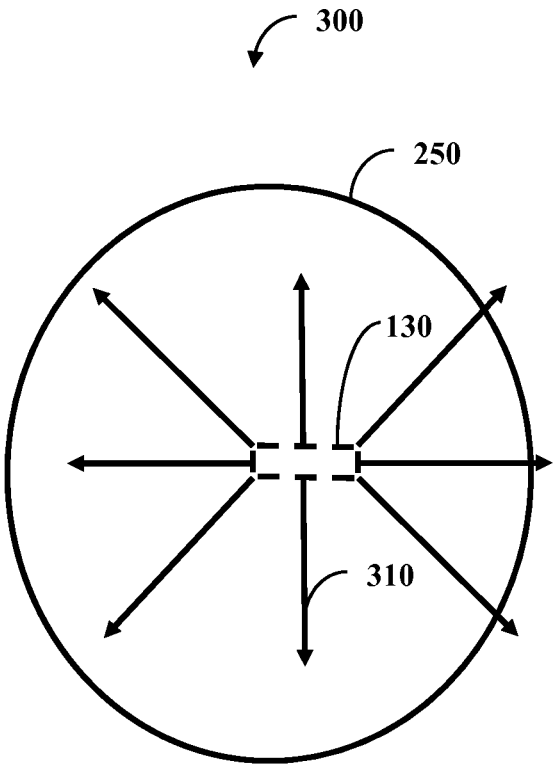
FIG. 3 illustrates one embodiment of a system from a top-down perspective.

FIG. 3 illustrates one embodiment of a system 300 from a top-down perspective. This top-down perspective illustrates the line feed 130 and the coaxial cable 250. While neither the separation 110 nor the dipole element 120 of FIG. 1 are illustrated, they can be included. The coaxial cable 250 can supply the line feed 130 with a current. This current can cause the line feed 130 to produce the electromagnetic field 310 (this can be the electromagnetic field discussed above).

The electromagnetic field 310 can be emitted substantially over a circumference of the coaxial cable 250. This way, the electromagnetic field 310 can be considered as returning to the coaxial cable 250 and in essence completing a loop. This can lead to improved performance of the system 200 of FIG. 2.

Figure 4:
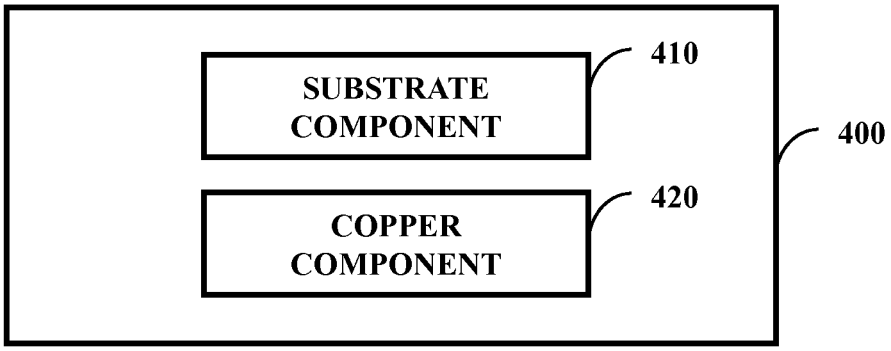
FIG. 4 illustrates one embodiment of a system comprising a substrate component and a copper component.

FIG. 4 illustrates one embodiment of a system 400 comprising a substrate component 410 and a copper component 420. The system 400 can be employed to create the system 100 of FIG. 1. The components 410 and 420 can include a hardware portion to physically perform tasks and software components to manage performance of those tasks.

The substrate component 410 can form a substrate that functions as the separation 110 of FIG. 1. A block of substrate material can enter the substrate component 410 and the substrate component 410 can determine desired dimensions (e.g., shape and thickness) of the substrate. The substrate component 410 can then cut the block of substrate material into the substrate with the desired dimensions.

The copper component 420 can form and/or attach to the substrate the dipole element 120 of FIG. 1. Similarly, the copper component 420 can form and/or attach to the substrate the line feed 130 of FIG. 1. The copper component 420 can be used when the dipole element 120 of FIG. 1 and/or the line feed 130 of FIG. 1 are made of copper. Another component can be used when the dipole element 120 of FIG. 1 and/or the line feed 130 of FIG. 1 are made of another material (e.g., a metallic material that is electrically conductive).

In one embodiment, a printing technique can be used by the copper component 420. The copper component 420 can cause the line feed 130 of FIG. 1 to be printed on a first side of the substrate. The copper component 420 can cause the dipole element 120 of FIG. 1 to be printed on an opposite side of substrate from the first side. This printing on these sides can occur concurrently and/or in series. Other manufacturing techniques other than printing can be used and a material other than copper can be used (e.g., used for the dipole element 120 of FIG. 1 and/or the line feed 130 of FIG. 1).

Figure 5:
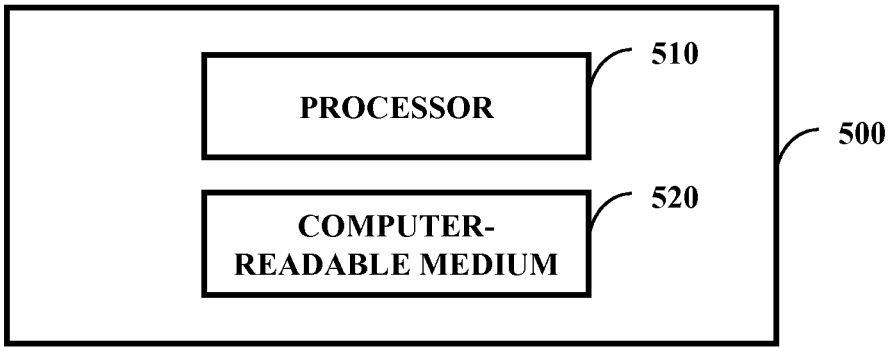
FIG. 5 illustrates one embodiment of a system comprising a processor and a computer-readable medium.

FIG. 5 illustrates one embodiment of a system 500 comprising a processor 510 (e.g., a general purpose processor or a specific processor for antenna production) and a computer-readable medium 520 (e.g., non-transitory computer-readable medium). In one embodiment, the computer-readable medium 520 is communicatively coupled to the processor 510 and stores a command set executable by the processor 510 to facilitate operation of at least one component disclosed herein (e.g., the substrate component 410 of FIG. 4). In one embodiment, at least one component disclosed herein (e.g., the copper component 420 of FIG. 4) can be implemented, at least in part, by way of non-software, such as implemented as hardware by way of the system 500. In one embodiment, the computer-readable medium 520 is configured to store processor-executable instructions that when executed by the processor 510 cause the processor 510 to perform a method disclosed herein (e.g., the methods 600-900 addressed below).

Figure 6:
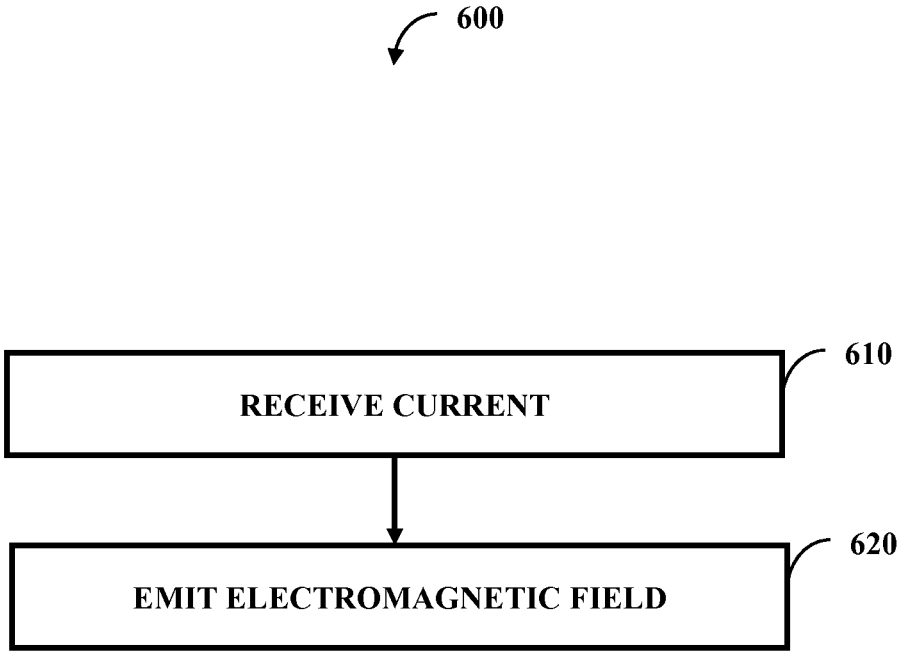
FIG. 6 illustrates one embodiment of a method on how a line feed can operate.

FIG. 6 illustrates one embodiment of a method 600 on how the line feed 130 of FIG. 1 can operate. At 610, the line feed 130 of FIG. 1 can receive a current. This current can be received from the coaxial cable 250 of FIG. 2 by way of the connector 240 of FIG. 2.

At 620, the line feed 130 of FIG. 1 can emit the electromagnetic field 310 of FIG. 3. The electromagnetic field 310 of FIG. 3 can be emitted multi-directionally. It may be possible for the electromagnetic field 310 of FIG. 3 to excite the dipole element 120 of FIG. 1 as well as be used for another purpose.

Figure 7:
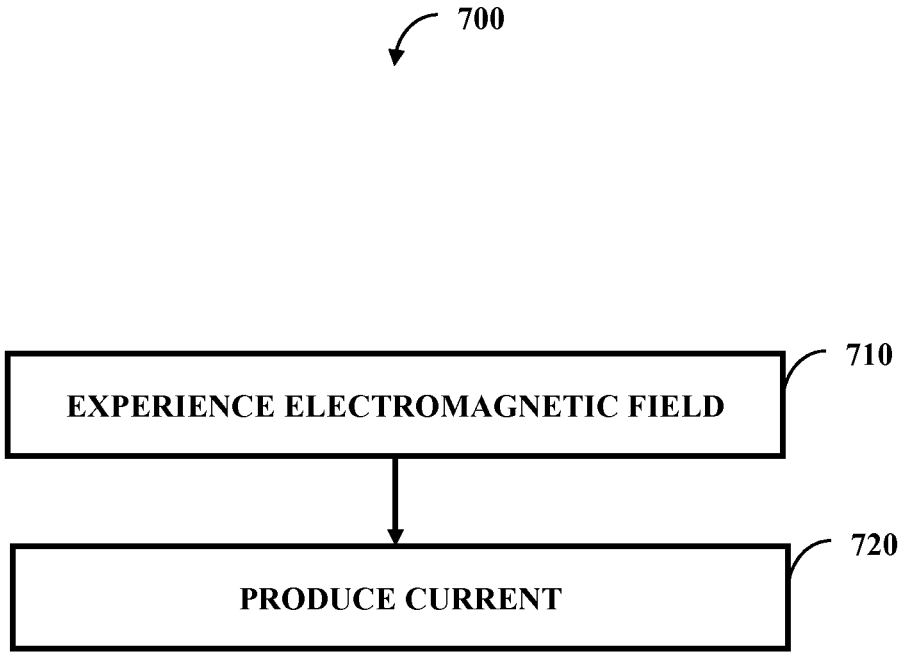
FIG. 7 illustrates one embodiment of a method on how a dipole element can operate.

FIG. 7 illustrates one embodiment of a method 700 on how the dipole element 120 of FIG. 1 can operate. At 710, the dipole element 120 of FIG. 1 can experience the electromagnetic field 310 of FIG. 3. At 720, the dipole element 120 can produce the current 230 of FIG. 2 from experiencing the electromagnetic field 310 of FIG. 3.

Figure 8:
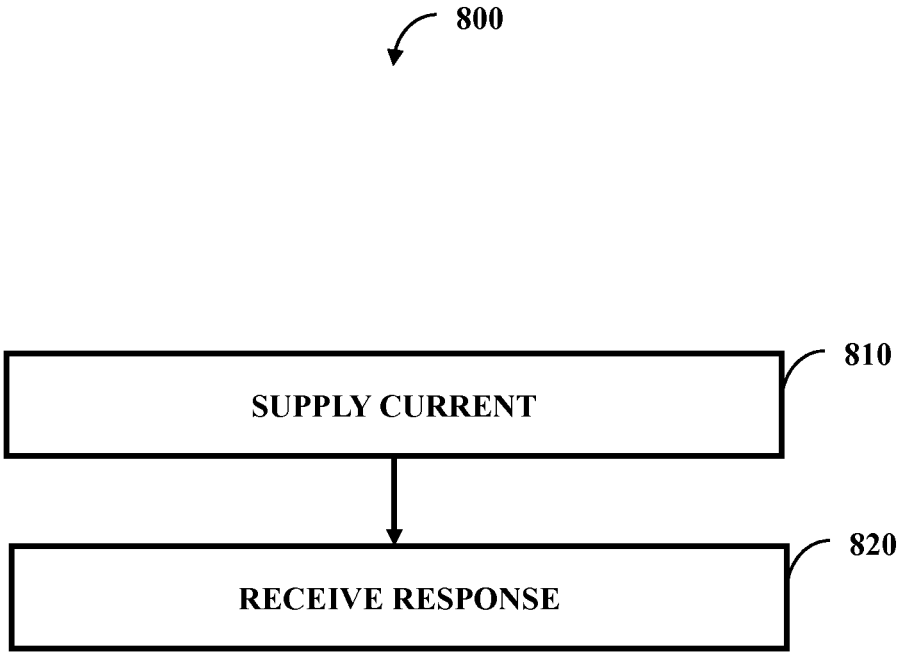
FIG. 8 illustrates one embodiment of a method on how a supply instrument can operate.

FIG. 8 illustrates one embodiment of a method 800 on how a supply instrument, such as the connector 240 of FIG. 2 or the coaxial cable 250 of FIG. 2, can operate. At 810, current can be supplied to the system 200 of FIG. 2. With this current, the system 200 of FIG. 2, by way of the line feed 130 of FIG. 2, can cause emission of the electromagnetic field 310 of FIG. 3. This electromagnetic field 310 of FIG. 3 can return within the supply instrument (e.g., substantially within a circumference of the supply instrument). This return can be considered as receiving a response at 820.

Figure 9:
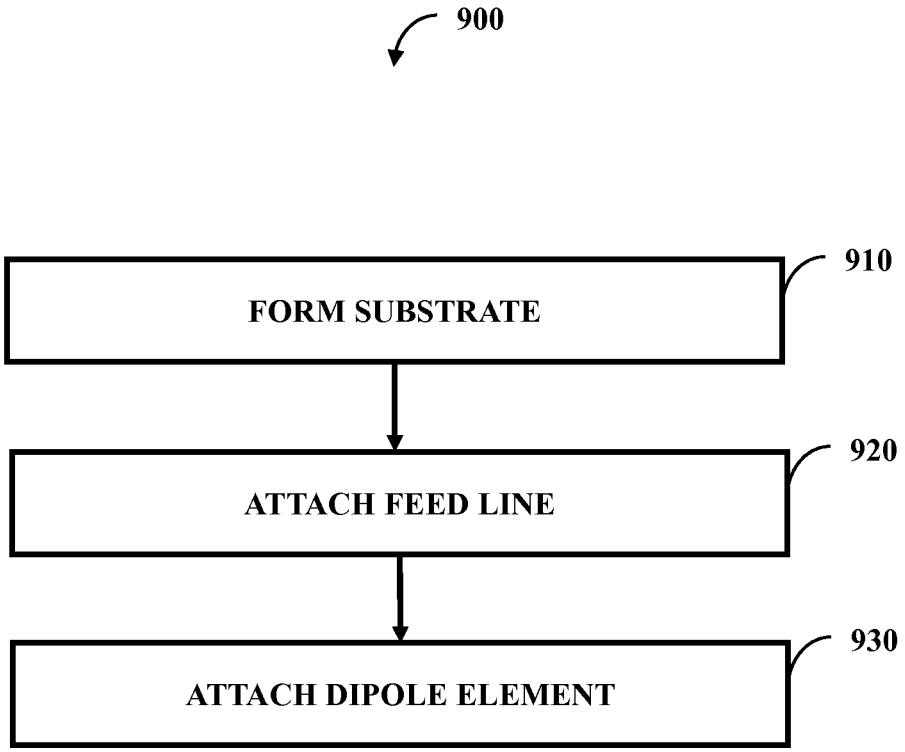
FIG. 9 illustrates one embodiment of a method for manufacture of at least one system disclosed herein.

FIG. 9 illustrates one embodiment of a method 900 for manufacture of at least one system disclosed herein, such as the system 100 of FIG. 1. A substrate can be placed into a manufacture apparatus. The manufacturing apparatus can form the substrate at 910. Additionally, the manufacture apparatus can attach the line feed 130 of FIG. 1 to the substrate at 920. At 930, the manufacture apparatus can attach the dipole element 120 of FIG. 1 to the substrate.

In one embodiment, the system 200 of FIG. 2 can be manufactured, by way of the method 900, such that a balun is not necessary for use (although one could be used if desired). As part of the method 900 there can be adding the connector 240 of FIG. 2 that allows for a current supply (e.g., the coaxial cable 250 of FIG. 2) to be directly connected to the system 200 of FIG. 2. This way, the method 900 can be part of a highly controlled and repeatable manufacturing process that can produce systems at a relatively low cost.

While the methods disclosed herein are shown and described as a series of blocks, it is to be appreciated by one of ordinary skill in the art that the methods are not restricted by the order of the blocks, as some blocks can take place in different orders. Similarly, a block can operate concurrently with at least one other block.

Aspects disclosed herein can used generally in the field of electromagnetics, such as in radio frequency engineering and antenna design. Use of the line feed 130 of FIG. 1 can allow for an impedance matched dipole antenna (e.g., the system 100 of FIG. 1 can be a dipole antenna). This impedance matched dipole antenna can have relatively wide impedance bandwidth and improved pattern shape.

The dipole element 120 of FIG. 1 can be sensitive to its electrical length due to its feed point impedance. As a result of the sensitive nature of the dipole element 120 of FIG. 1, an optimal Radio Frequency (RF) performance can be limited to a narrow bandwidth due to the impedance mismatch with a transmission line as frequency varies. The dipole element 120 of FIG. 2 can be designed to be RF balanced (e.g., both radiating elements 210 and 220 of FIG. 2 have equal yet opposite traveling voltage with respect to ground). For this reason a preferred feeding method could be using a balanced transmission line. However a common transmission line used in applications is coaxial. Coaxial cable can be unbalanced indicating a single ground potential. By feeding an RF balanced antenna, such as a dipole antenna, with an unbalanced transmission line, many undesirable characteristics can surface as a result of this combination. A typical radiation pattern for the dipole antenna can be an omnidirectional toroid shape, when combining a balanced antenna with an unbalanced transmission line the radiation pattern is distorted due to common mode currents causing the unbalanced cable to radiate. Also, an impedance can be changed, thus creating mismatch which reduces power transfer and increases signal reflections. To reduce effects of the mismatch, a balun can be added between the transmission line (e.g., the coaxial cable 250 of FIG. 2) and an antenna feed terminal (e.g., the connector 240 of FIG. 2) to convert the unbalanced signal current to a balanced one for the dipole element 120 of FIG. 2. While the balun alleviates at least some of the degradation that occurs when using mismatched antenna and line, the balun adds complexity to the antenna design. In addition, the antenna naturally has a larger and possibly undesirable footprint due to the added balun. Also, the balun introduces added costs due to the cost of the unit itself and additional antenna fabrication step. In view of this, it may be desirable to have a design with similar results without using the balun.

What is claimed is:

1. A system, comprising:
a dipole element;
a line feed; and
a connector configured to directly connect with a coaxial cable,
where the coaxial cable supplies the current to the line feed,
where the line feed is configured to be supplied with a current such that the line feed emits an electromagnetic field when supplied with the current, and
where the electromagnetic field excites the dipole element such that the dipole element is balanced.

2. The system of claim 1, where the dipole element and the line feed do not touch.

3. The system of claim 2, where the dipole element and the line feed are separated, at least in part, by a solid substrate.

4. The system of claim 3,
where the line feed is physically supported by the solid substrate and
where the dipole element is physically supported the solid substrate.

5. The system of claim 1, where the electromagnetic field is emitted substantially over a circumference of the coaxial cable.

6. The system of claim 1, where the coaxial cable is unbalanced.

7. A system, comprising:
a dipole element; and
a line feed,
where the line feed is configured to be supplied with a current such that the line feed emits an electromagnetic field when supplied with the current, and
where the electromagnetic field excites the dipole element such that the dipole element is balanced,
where the dipole element and the line feed are on substantially parallel planes to one another that are different planes.

8. A system, comprising:
an antenna, comprising:
a separator that is, at least in part, a solid substrate;
a line feed that is printed on the solid substrate; and
a dipole element that is printed on the solid substrate; and
a connector configured to connect to a current supply to the antenna such that the line feed is provided the current,
where the separator separates the dipole element from the in feed such that the dipole element and the line feed do not touch,
where when the line feed is provided the current the line feed emits an electromagnetic field that interacts with the dipole element, and
where the dipole element is excited by the electromagnetic field such that current flows through the dipole element.

9. A system, comprising:
an antenna, comprising:
a dipole element;
a line feed; and
a separator that separates the dipole element from the line feed such that the dipole element and the line feed do not touch; and
a connector configured to connect to a current supply to the antenna such that the line feed is provided the current,
where when the line feed is provided the current the line feed emits an electromagnetic field that interacts with the dipole element,
where the dipole element is excited by the electromagnetic field such that current flows through the dipole element,
where the current supply is a coaxial cable,
where the electromagnetic field is emitted substantially over a circumference of the coaxial cable, and
where the coaxial cable connects directly to the connector absent a balun.

10. A system, comprising:
an antenna, comprising:
a dipole element;
a line feed; and
a separator that separates the dipole element from the line feed such that the dipole element and the line feed do not touch; and
a connector configured to connect to a current supply to the antenna such that the line feed is provided the current,
where when the line feed is provided the current the line feed emits an electromagnetic field that interacts with the dipole element,
where the dipole element is excited by the electromagnetic field such that current flows through the dipole element,
where the current supply is unbalanced and introduces an impedance mismatch,
where the dipole element is balanced when current flows through the dipole element, and
where the line feed causes a mitigation of the impedance mismatch.

11. A system, comprising:

an antenna, comprising:

a dipole element;

a line feed; and a separator that separates the dipole element from the line feed such that the dipole element and the line feed do not touch; and a connector configured to connect to a current supply to the antenna such that the line feed is provided the current, where when the line feed is provided the current the line feed emits an electromagnetic field that interacts with the dipole element, where the dipole element is excited by the electromagnetic field such that current flows through the dipole element, where the dipole element and the line feed are on substantially parallel planes to one another.

12. A system, comprising:

a dipole element comprising a first radiating element and a second radiating element; and a line feed substantially parallel to the dipole element that does not touch the dipole element, where the line feed emits an electromagnetic field that excites the dipole element such that the first radiating element and the second radiating element have current travelling in a uniform direction.

13. The system of claim 12, where the dipole element and the line feed are separated, at least in part, by a solid substrate.

14. The system of claim 13, where the line feed physically touches the solid substrate, where the dipole element physically touches the solid substrate at a side opposite the line feed side, and where the line feed and the dipole element do not physically touch.

15. The system of claim 14, comprising:

a connector configured to directly connect with a coaxial cable, where the coaxial cable supplies a current to the line feed and where the line feed uses the current to emit the electromagnetic field.

16. The system of claim 15, where the electromagnetic field is emitted substantially over a circumference of the coaxial cable.

17. The system of claim 16, where the depth of the solid substrate that separates the dipole element from the line feed influences impedance matching of the dipole element.

18. The system of claim 1, where the dipole element and the line feed are on substantially parallel planes to one another that are different planes.

19. The system of claim 7, comprising:

a connector configured to directly connect with an unbalanced coaxial cable, where the unbalanced coaxial cable supplies the current to the line feed and where the electromagnetic field is emitted substantially over a circumference of the unbalanced coaxial cable.

20. The system of claim 7, where the dipole element and the line feed are separated, at least in part, by a solid substrate, where the line feed is physically supported by the solid substrate and where the dipole element is physically supported the solid substrate.

* * * * *